United States Patent [19]

Tsao

[11] Patent Number: 5,030,961

[45] Date of Patent: Jul. 9, 1991

[54] MICROSTRIP ANTENNA WITH BENT FEED BOARD

[75] Inventor: Chich-Hsing A. Tsao, Saratoga, Calif.

[73] Assignee: Ford Aerospace Corporation, Palo Alto, Calif.

[21] Appl. No.: 508,217

[22] Filed: Apr. 10, 1990

[51] Int. Cl.[5] ..... H01Q 1/38

[52] U.S. Cl. ..... 343/700 MS; 343/705; 343/770

[58] Field of Search ..... 343/700 MS, 705, 770, 343/771, 767, 845, 846, 729, 768

[56] References Cited

U.S. PATENT DOCUMENTS

| | | | |
|---|---|---|---|
| 4,843,400 | 6/1989 | Tsao et al. | 343/700 MS |
| 4,899,164 | 2/1990 | McGrath | 343/700 MS |
| 4,903,033 | 2/1990 | Tsao et al. | 343/700 MS |

*Primary Examiner*—Michael C. Wimer
*Assistant Examiner*—Hoanganh Le
*Attorney, Agent, or Firm*—Rosenblum, Parish & Bacigalupi

[57] ABSTRACT

A microstrip antenna including an orthogonal planar array (12) of patch radiators (10) with specially configured feed boards (16) provided for each column of array elements. Each such board includes a portion disposed parallel to the plane of the array and one or more portions bent or folded to extend in the direction of the array axis for a distance sufficient to accommodate necessary circuitry (36) and active devices (40). A metal supporting frame (18) serves both as a common ground for the assembly and as a heat sink for conducting some of the heat generated by the active devices mounted to the feed boards. An additional planar circuit board (22) is positioned beneath the supporting frame to accommodate the power combining circuit and to interconnect all of the elements. Connection between feed boards (16) and combiner board (22) is accomplished using via-connections or a coaxial cable network. The hollows formed by the specially configured feed boards provide passageways for cooling air circulation and further enhance heat dissipation within the device.

14 Claims, 2 Drawing Sheets

MICROSTRIP ANTENNA WITH BENT FEED BOARD

BACKGROUND OF THE INVENTION

1. Field of the Invention

The present invention relates generally to microstrip antenna apparatus and more particularly to an improved microstrip antenna array structure in which bent or folded circuit boards are used to significantly increase the surface area available for the integration of circuits and components on a single layer of feed circuit board.

2. Description of the Prior Art

Conventional microstrip printed array antennas employ multiple layer, planar laminated circuit boards to accommodate the multitude of interconnections required to connect discrete active components such as amplifiers and phase shifters to the printed array. The use of such boards requires complex interboard connections, and the size of the discrete active components to be integrated into the array is constrained by the spacing between the array radiating elements. In addition, dissipation of heat in such structures poses a substantial problem.

More specifically, the conventional multiple layer laminated structure consists of multiple layers of circuit boards with patch radiating elements, RF power combining network, control logic circuit, and active components residing on the various layers. The electrical interconnections between boards is usually accomplished by via-holes. The use of multiple layers is necessary because the spacing between the antenna elements, typically on the order of 0.5 to 0.7 wavelengths, is too small to allow sufficient surface area behind each radiating element to accommodate all of the circuitry in one layer. Accordingly, fabrication of such an antenna is usually complex and expensive. Furthermore, it requires a high degree of precision in aligning the various boards which often have different thermal and mechanical properties. Via-hole etching through multiple boards can be used to overcome some of the problems but is very costly and the heat dissipation associated with any active components embedded in the mid-layers is nearly always a problem.

SUMMARY OF THE INVENTION

Briefly, a presently preferred embodiment of the present invention includes an orthogonal planar array (12) of patch radiators with specially configured feed boards (16) provided for each column of array elements. Each such board includes a portion disposed parallel to the plane of the array (12) and one or more portions bent or folded to extend in the direction of the array axis for a distance sufficient to accommodate necessary circuitry (36) and active devices (40). A metal supporting frame (20) serves both as a common ground for the assembly and as a heat sink for conducting some of the heat generated by the active devices mounted to the feed boards. An additional planar circuit board (22) is positioned beneath the supporting frame (18) to accommodate the power combining circuit and to interconnect all of the elements. Connection between feed boards (16) and combiner board (22) is accomplished using via-connections or a coaxial cable network. The hollows formed by the specially configured feed boards provide passageways for cooling air circulation and further enhance heat dissipation within the device.

An important advantage of the present invention is that the circuitry and active devices needed for an entire column of elements in a phased array can be accommodated in a single feed board.

Another advantage of the present invention is that neither multiple board alignment nor multilayer via-hole etching is required.

Still another advantage of the present invention is that it inherently provides better heat dissipation within a complex array circuit.

DETAILED DESCRIPTION OF THE PREFERRED EMBODIMENT

Figure 1:
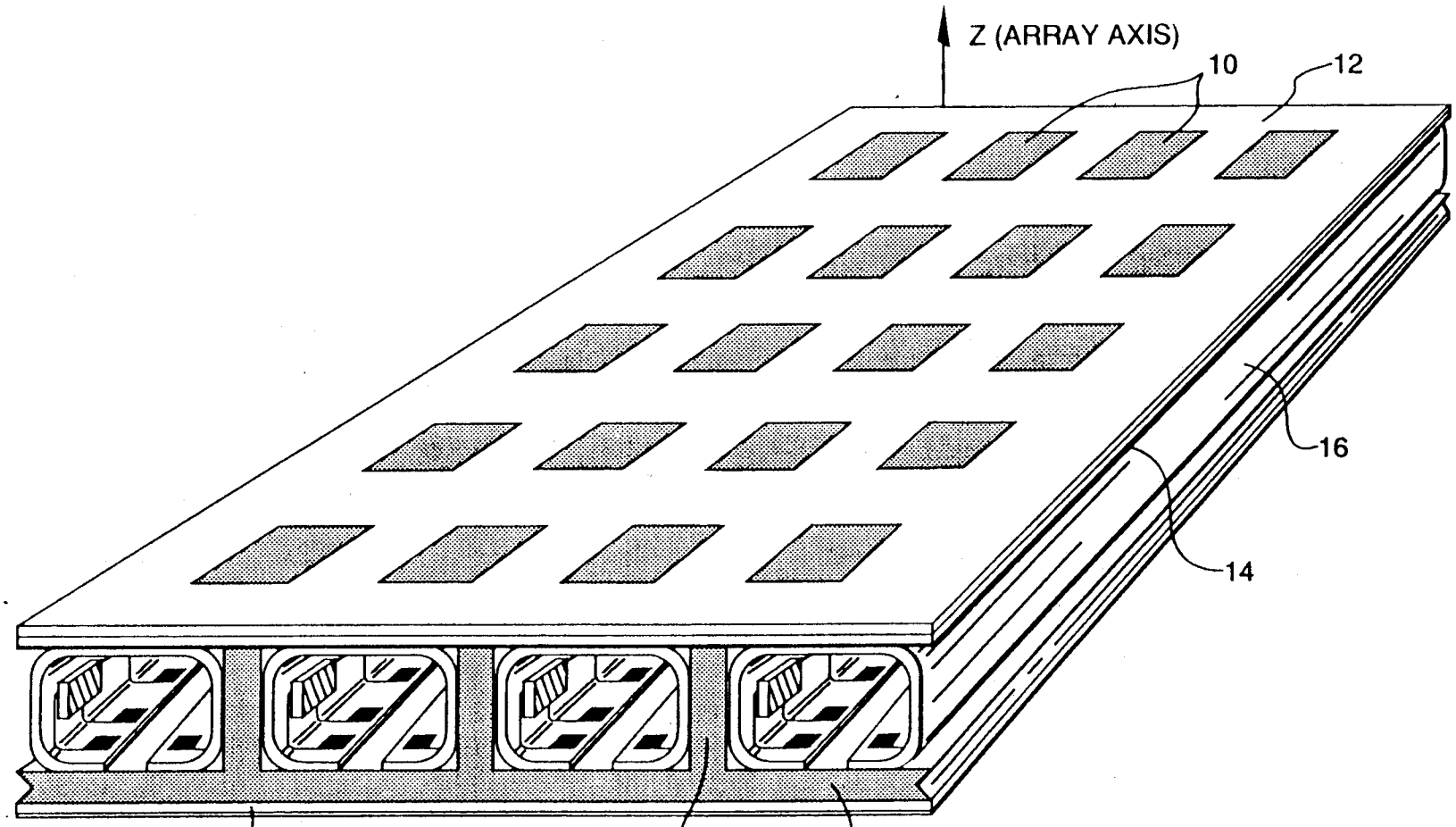
FIG. 1 is a perspective view illustrating a microstrip phased array antenna in accordance with the present invention.

Referring now to FIG. 1 of the drawing, a microstrip phased array antenna device in accordance with the present invention is depicted which includes a planar array of orthogonally disposed patch radiators 10 formed on the upper surface of an antenna substrate 12 having affixed to the lower surface thereof, a ground plane 14 for the radiators. Lying beneath each column of radiators is a column feed circuit board 16 formed to have a generally C-shaped transverse cross-section. The several feed boards 16 are mounted to a metal supporting frame 18 comprised of a planar base having upstanding ribs 20 extending parallel to the columns and positioned between adjacent boards 16. The frame 18 provides structural rigidity to the device as well as serving as a heat sink. Affixed to the bottom surface of frame 18 is an RF power combiner board which serves to interconnect all of the columns.

Figure 2:
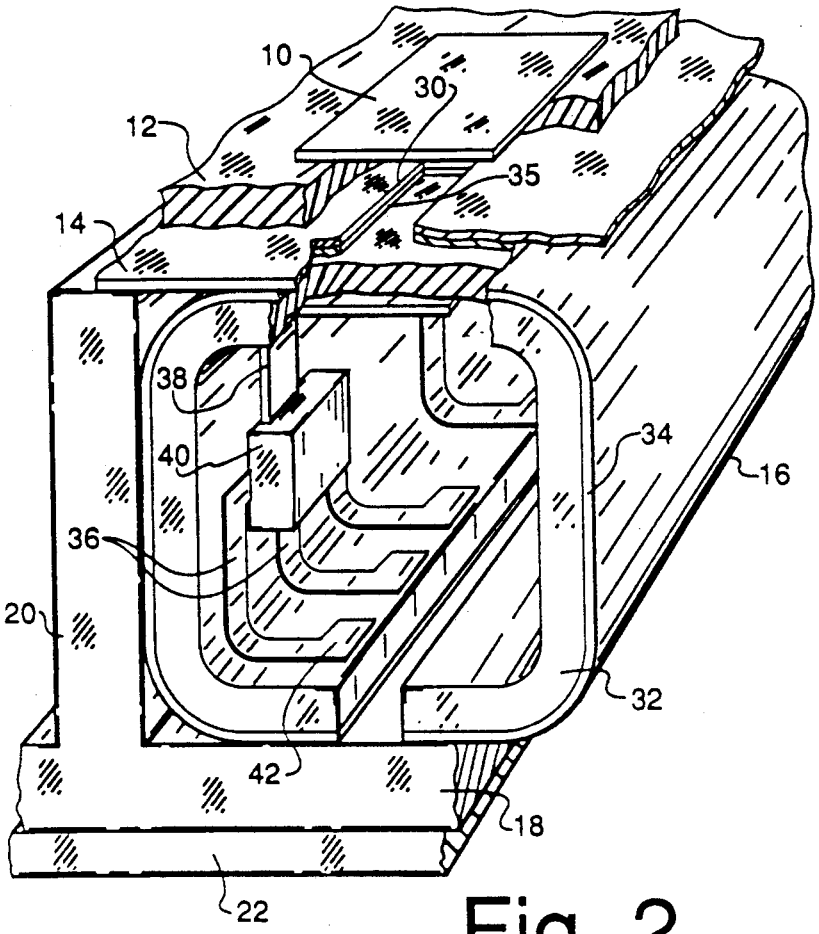
FIG. 2 is a broken away segment of the antenna illustrated in FIG. 1, showing the various components associated with a single patch element.

Turning now to FIG. 2 of the drawing, details of the structure are more clearly indicated. As depicted, each patch radiator 10 is of a suitable metallic material plated to the top surface of a non-conductive substrate 12 which in turn has plated to the bottom side thereof, the ground plane 14. Etched from the ground plane 14 during the manufacture thereof is a plurality of rectangular coupling apertures 30, the elongated dimensions of which extend parallel to the column length. Each aperture 30 is positioned to lie directly beneath the center of a corresponding patch radiator 10.

Circuit board 16 is comprised of a non-conductive substrate 32 having one side continuously plated to provide a ground plane 34 having a plurality of rectangular openings 35 corresponding to the apertures 30, and the other side provided with an array of conductive traces 36 to which the contact pads of an appropriate active device, such as an MIC/MMIC for phase shifters, amplifiers, switches, etc., may be attached. Note also that a microstrip feed line 38 is provided. Feed line 38 extends transverse to the elongated dimension of opening 35 and crosses beneath the center thereof.

After each board is fabricated and the active devices 40 are attached, the board is formed into a channel-like tubular configuration having a generally C-shaped cross-section. Note that the vertical sides of feed boards 16 can be made of any suitable length to accommodate as many active devices and associated lead traces as is required.

In constructing the device, the column boards 16 are positioned within the slots formed by ribs 20, and the pads 42 are via-connected, or alternatively are coaxially connected, to the appropriate traces of the RF combiner board 22. The ground plane 34 is soldered or otherwise connected to the frame 18. The patch array board, including patches 10, substrate 12 and ground plane 14, is then positioned over the assembly with the coupling apertures 30 aligned with the slots 35 in the ground plane 34 of each feed board 16. The patch array board is affixed to the frame and/or feed board assembly by suitable means such as non-conductive clamping screws or pins, or the like (not shown).

In operation, heat generated within the various components is conducted to frame 18 and is dissipated thereby. In addition, convective cooling is provided by the flow of air through the internal passageways formed by the channel-shaped feed boards.

In the preferred embodiment, the non-conductive substrate of feed board 32 is comprised of a teflon-impregnated fiberglass material, typically having a thickness of approximately 0.010 to 0.025 inch, and the circuit traces 36 and 38 and ground plane 34 are typically etched metallic platings of thickness within the range 0.0005 to 0.001 inch. The thickness of substrate 12 is typically two percent (2%) to ten percent (10%) of the operational wavelength of the device.

Figure 3:
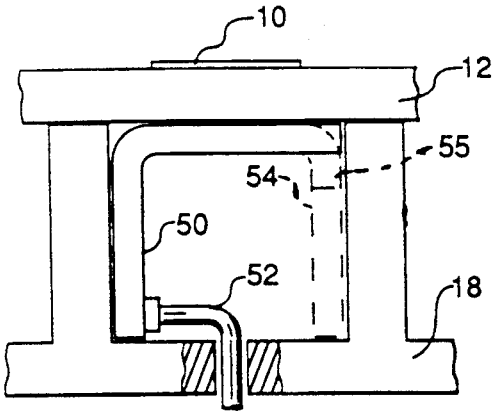
FIGS. 3 and 4 illustrate alternate configurations for the feed circuit board of the present invention.
Figure 4:
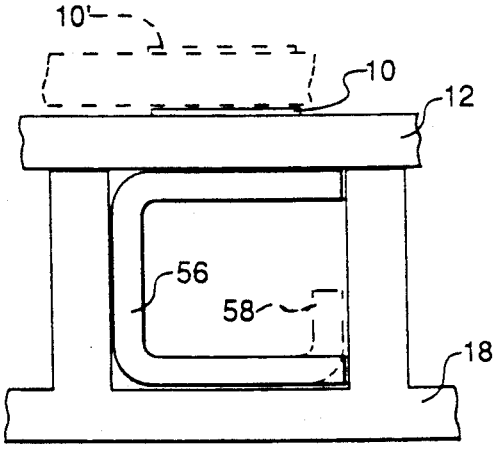

Although the present invention has been described in terms of a presently preferred embodiment, it will be appreciated that various alterations and modifications thereof will be apparent to those skilled in the art after having read the above description. For example, in order to provide a device having a broader bandwidth, a second patch radiator layer (as depicted by the dashed lines 10' in FIG. 4) may be disposed above that depicted. Furthermore, the cross-sectional configuration of the feed boards 16 may be modified to have other folded configurations which may, for example, be U-shaped, J-shaped, G-shaped or have any other configuration suited to a particular application. In FIG. 3, alternative configurations for the feed board are suggested. One version is in the form of an L-shaped configuration 50 in which power feed is accomplished through a coaxial connector 52. A similar alternative configuration would be the inverted U-shaped embodiment 54. Another variation would be to foreshorten one of the legs of the U-shaped configuration to provide an inverted J-shaped embodiment. Depicted in FIG. 4 is an open C-shaped board 56 and an alternate G-shaped board 58, both of which would normally be via-connected to the power combiner.

Accordingly, it is intended that the appended claims be interpreted as covering all such alterations and modifications as fall within the true spirit and scope of the invention.

What is claimed is:

1. A microstrip antenna comprising:

patch radiator means including a support means, having an upper surface and a lower surface, and a plurality of patch radiator elements arrayed in rows and columns upon said upper surface of said support means;

a plurality of elongated feed circuit board means being engaged to said lower surface of said support means, each said feed circuit board means having a first portion disposed in a plane that is parallel to said patch radiator elements, and an integral second portion which is deformed to lie out of the plane of said first portion, each said feed circuit board means having a ground plane being formed on a first surface thereof and a plurality of conductive trances formed on a second surface thereof, said traces including means forming a plurality of feed lines, each of said feed lines being coupled through a corresponding slot formed in said ground plane to one of said patch radiator elements; and means for coupling electrical energy to said conductive traces such that said feed lines are caused to couple energy to said patch radiator means for external radiation from said antenna.

2. A microstrip antenna as recited in claim 1 and further comprising a heat-conducting frame means having a planar base and a plurality of elongated ribs that project perpendicularly from said base, said ribs being disposed to support said patch radiator means, and wherein said elongated feed circuit board means are disposed atop said planar base of said heat-conducting frame and adjacent to at least one of said ribs.

3. A microstrip antenna as recited in claim 2 wherein each said feed circuit board means is formed to have a generally C-shaped transverse cross-section with said ground plane being formed on the exterior surfaces thereof and said conductive traces being formed on the interior surfaces thereof.

4. A microstrip antenna as recited in claim 3 wherein the interior surfaces of said feed circuit board means form passageways through which a heat conducting flow of air may pass to aid in the cooling of said antenna.

5. A microstrip antenna as recited in claim 4 and further comprising a plurality of electrically active devices disposed within said passageways and electrically connected to said conductive traces.

6. A microstrip antenna as recited in claim 5 wherein said frame means is comprised of a planar base having a plurality of upstanding ribs with each said rib being disposed between an adjacent pair of said feed circuit board means.

7. A microstrip antenna as recited in claim 2 wherein each said feed circuit board means is formed to have a generally inverted U-shaped transverse cross-section with said ground plane being formed on the exterior surfaces thereof and said conductive traces being formed on the interior surfaces thereof.

8. A microstrip antenna as recited in claim 2 wherein each said feed circuit board means is formed to have a generally Gshaped transverse cross-section with said ground plane being formed on the exterior surfaces thereof and said conductive traces being formed on the interior surfaces thereof.

9. A microstrip antenna as recited in claim 2 wherein each said feed circuit board means is formed to have a generally inverted L-shaped transverse cross-section with said ground plane being formed on the exterior surfaces thereof and said conductive traces being formed on the interior surfaces thereof.

10. A microstrip antenna as recited in claim 2 wherein each said feed circuit board means is formed to have a generally inverted J-shaped transverse cross-section with said ground plane being formed on the exterior surfaces thereof and said conductive traces being formed on the interior surfaces thereof.

11. A microstrip antenna as recited in claim 2 wherein said frame means is comprised of a planar base having a plurality of upstanding ribs with each said rib being disposed between an adjacent pair of said feed circuit board means.

12. A microstrip antenna as recited in claim 11 wherein the cross-section of said feed circuit board means is selected from the group consisting of generally C-shaped, inverted L-shaped, inverted U-shaped, G-shaped and inverted J-shaped, and said feed circuit board means combine with said frame means to define passageways.

13. A microstrip antenna as recited in claim 12 and further comprising a plurality of electrically active devices disposed within said passageways and electrically connected to said conductive traces.

14. A microstrip antenna as recited in claims 1, 2, 6, 12 or 13 and further comprising an additional patch radiator means disposed above the first mentioned patch radiator means for the purpose of broadening the bandwidth of said antenna.

* * * * *